US006381432B1

(12) United States Patent
Hattori

(10) Patent No.: US 6,381,432 B1
(45) Date of Patent: Apr. 30, 2002

(54) CHARGING DEVICE HAVING A TONER REMOVER

(75) Inventor: Tomoaki Hattori, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/399,745

(22) Filed: Sep. 20, 1999

(30) Foreign Application Priority Data

Dec. 16, 1998 (JP) ..... 10-357969
Dec. 16, 1998 (JP) ..... 10-358022

(51) Int. Cl.[7] ..... G03G 15/02; G03G 21/00
(52) U.S. Cl. ..... 399/176; 361/221; 361/225; 399/99; 399/100
(58) Field of Search ..... 399/168, 174, 399/176, 50, 100, 88, 90; 361/221, 225

(56) References Cited

U.S. PATENT DOCUMENTS 5,146,280 A * 9/1992 Kisu ..... 399/176
5,666,608 A * 9/1997 Christensen ..... 399/176
5,669,047 A * 9/1997 Okuda et al. ..... 399/174
5,697,020 A * 12/1997 Sato et al. ..... 399/100
5,768,653 A * 6/1998 Fare ..... 399/50
5,768,660 A * 6/1998 Kurihara et al. ..... 361/221 X
5,799,229 A * 8/1998 Yokoyama et al. ..... 399/100
5,845,177 A * 12/1998 Choi ..... 361/225 X
5,970,302 A * 10/1999 Yamane ..... 399/50 X
5,974,277 A * 10/1999 Yamane et al. ..... 399/50
6,029,029 A * 2/2000 Danzuka ..... 399/100
6,088,551 A * 7/2000 Satoh et al. ..... 399/100

FOREIGN PATENT DOCUMENTS

JP 10-239946 * 9/1998

* cited by examiner

*Primary Examiner*—Susan S. Y. Lee
(74) *Attorney, Agent, or Firm*—Oliff & Berridge, PLC

(57) ABSTRACT

In order to apply bias to a charging roller for charging a surface of a photoconductive drum uniformly, a power supply roller, which rotates while contacting with a surface of the charging roller, is provided. Brushes may be provided on the surface of the power supply roller. Further, by providing a member for removing a toner and sheet particles adhering to the surfaces of the charging roller and the power supply roller, the surface of the charging roller can be maintained in a clean condition and the surface of the photoconductive drum can be charged statically and uniformly.

22 Claims, 6 Drawing Sheets

CHARGING DEVICE HAVING A TONER REMOVER

BACKGROUND OF THE INVENTION

1. Field of the Invention

The present invention relates to a charging device used in devices, such as laser beam printers, copiers, facsimile devices, or the like, which form images using an electrophotographic method.

2. Description of the Related Art

In an image forming apparatus using an electrophotographic method, in order to charge a surface of a photoconductive drum uniformly, a colotron charging device or a scolotron charging device using corona discharge is generally used.

This is one of the typical charging methods where a photoconductive drum is made to be at an uniform potential by applying high voltage to fine wires to generate the corona discharge.

The fine wires are used for the colotron charging device or the scolotron charging device. However, they are easy to break, so that a replacement of wires is very troublesome. Also, ozone may be evolved when generating the corona discharge, so that such kinds of charging devices may have many other problems.

Therefore, a charging method which is maintained easily and does not evolve ozone, has been recently used. The charging method uses a charging device that includes a charging roller is well-known as a charging device for. Such a charging device will be described while referring to FIGS. 8A and 8B.

As shown in FIG. 8A, a charging roller 40 comprises a semiconductive layer 43 which is provided around a base 41 formed from aluminum and a shaft 42. A power supply 45 is connected to the shaft 42 to apply the necessary voltage for charging. The semiconductive layer 43 is formed by performing a doping or a coating on the base 41 or covering a heat shrinkable tube. On both ends of the charging roller 40, space holder members 44 formed from polyacetal are provided. Each space holder member 44 has a disk shape and a hole provided its center, and the shaft 42 is placed in the holes.

A diameter of the space holder member 44 is slightly larger than that of the charging roller 40 structured with the base 41 and the semiconductive layer 43. Therefore, as shown in FIG. 8B, only the space holder members 44 contact with a photoconductive drum 46, so that a slight narrow discharge space d can be obtained between the photoconductive drum 46 and the semiconductive layer 43. When the voltage is applied to the shaft 42 from the power supply 45, the photoconductive drum 46 is charged uniformly at the predetermined charging potential.

According to such charging method, the space d between the photoconductive drum 46 and the semiconductive layer 43 can be extremely narrow. Therefore, the charging can be performed using low impressed voltage and the evolvement of ozone can be extremely lessened.

According to the conventional charging method, the current flows from the shaft 42 of the charging roller 40 to the semiconductive layer 43 via the base 41, so that it is impossible to obtain a sufficient resistance for charging with stability. The insufficient resistance causes charging defects, such as irregular charging, and reduction of image quality.

SUMMARY OF THE INVENTION

One aspect of the invention is to provide a charging device capable of charging with stability. The charging device is so disposed as to leave an extremely narrow space between its surface and a photosensitive member, and includes a charging member for charging the surface of the photosensitive member and a power supply member for supplying a current to the charging member, so disposed as to contact with the surface of the charging member. The power supply member may also have conductivity and elasticity.

The charging device may further comprise a press member for pressing the power supply member toward the surface of the charging member, and a nip width of a portion where the power supply member and the charging member contact each other may be 0.1 mm or more.

A cleaning member for cleaning the surface of the charging member can be so provided as to contact with the surface of the charging member. Then, toner and sheet particles can be removed from the surface of the charging member, so that the photoconductive drum can be charged uniformly.

A cleaning member may also be so provided as to contact with the surface of the power supply member in order to clean the surface of the power supply member.

Further, as the charging member, a roller-shaped member comprising a shaft portion, a base which is made from insulation material and provided around the shaft portion, a charging portion which is made from semiconductive material and provided around the base, and collars which are provided on the both ends of the shaft portion and have a slightly larger diameter than a diameter united the shaft portion, the base, an the charging portion, can be provided.

Still further, as the power supply member, a roller-shaped member comprising a shaft portion and a power supply portion which have conductivity and elasticity and provided around the shaft portion can be provided. A power supply may be connected to the shaft portion.

Moreover, for cleaning the surface of the power supply member, brushes having conductivity and elasticity can be provided on the surface of the power supply member.

Furthermore, a cleaning member for cleaning a cleaning roller may be so provided as to contact with the brushes of the power supply member and the cleaning roller made from conductive material. A power supply capable of applying positive and negative potentials is connected to the cleaning roller, so that positively and negatively charged toner and sheet particles can be removed from the brushes, and the photoconductive drum can be charged uniformly.

BRIEF DESCRIPTION OF THE DRAWINGS

A preferred embodiment of the present invention will be described in detail with reference to the following figures wherein.

DETAILED DESCRIPTION OF THE PREFERRED EMBODIMENT

An embodiment of a charging device of the invention provided with a laser beam printer will be described while referring to the accompanying drawings.

Figure 1:
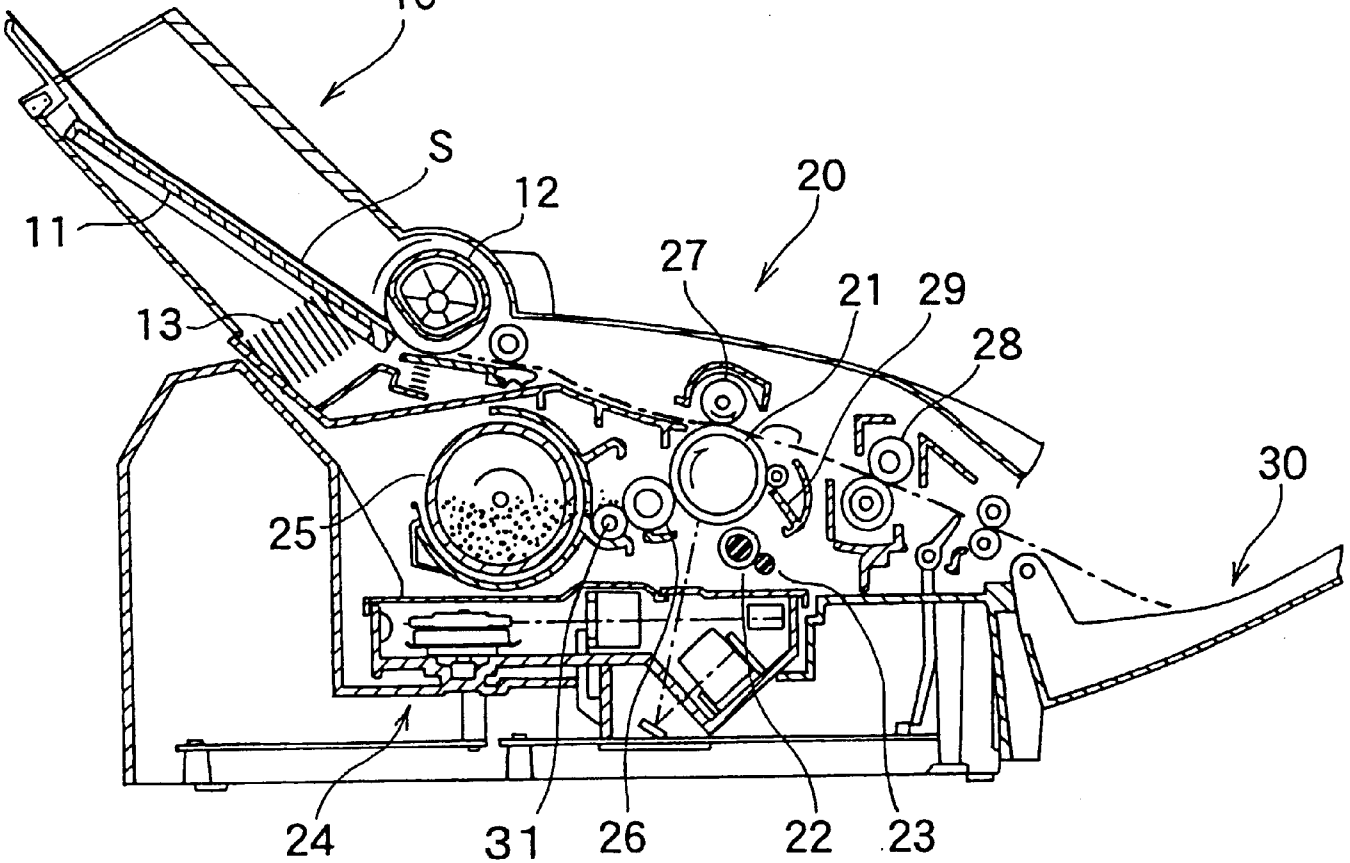
FIG. 1 is a sectional view of a laser beam printer including a charging device according to an embodiment of the present invention.

FIG. 1 is a sectional view of a laser beam printer. The laser beam printer generally includes a sheet feed unit 10 for feeding a sheet S, an image forming unit 20 for performing various processes, such as charging, exposing, developing, transferring, fixing, and cleaning, and a sheet discharge unit 30 for discharging the sheet S.

The sheet feed unit 10 has a sheet feed roller 12 for feeding the sheet S to the image forming unit 20. Provided on the rear portion of the sheet feed roller 12 is a holding plate 11, whose rear end portion is supported slidable, for holding the sheet S. Provided at lower portion of the holding plate 11 is a compression spring 13 for pressing the holding plate 11 toward the sheet feed roller 12. As the sheet feed roller 12 is driven by a drive device (not shown) at a timing for feeding sheet, the sheet S on the holding plate 11 is picked up by the sheet feed roller 12 and fed to the image forming unit 20.

The image forming unit 20 includes a photoconductive drum 21, which a photoconductive layer whose electric characteristics change according to an irradiation of lights, is formed thereon. Disposed at lower portion of the photoconductive drum 21 is a charging roller 22 for charging static electricity. Contacted with the surface of the charging roller 22 is a power supply roller 23 for supplying electricity to the charging roller 22. The surface of the photoconductive drum 21 is charged at an uniform electric potential by the charging roller 22.

Disposed at lower portion of the photoconductive drum 21 is a scanner 24 for irradiating a laser beam, which is modulated according to a printing pattern, to the surface of the photoconductive drum 21. An electrostatic latent image is formed on the surface of the photoconductive drum 21 by such that the laser beam discharged from the scanner 24 is irradiated on the surface of the charged photoconductive drum 21.

Contacted with the surface of the photoconductive drum 21 is a developing roller 26 having toner on a surface thereof. The toner is stored within a toner box 25 and transferred to the developing roller 26 by a feed roller 31. The toner on the developing roller 26 adheres to the surface of the photoconductive drum 21 according to the electrostatic latent image.

Disposed at upper portion of the photoconductive drum 21 is a transfer roller 27. The sheet S is fed between the photoconductive drum 21 and the transfer roller 27 by the sheet feed roller 12. The toner on the surface of the photoconductive drum 21 adheres to the surface of the sheet S by the bias applied to the transfer roller 27. The remaining toner on the surface of the photoconductive drum 21 that is not transferred to the surface of the sheet S, is collected by a cleaner 29.

The sheet S adhering the toner is transferred to a fixing device 28 and the toner is fixed onto the sheet S by heat and pressure. The sheet S to which the toner is fixed thereof in this manner, is discharged to the sheet discharge unit 30.

Next, structures of the charging roller 22 and the power supply roller 23 will be described in detail while referring to FIGS. 2, 3, and 4.

Figure 2:
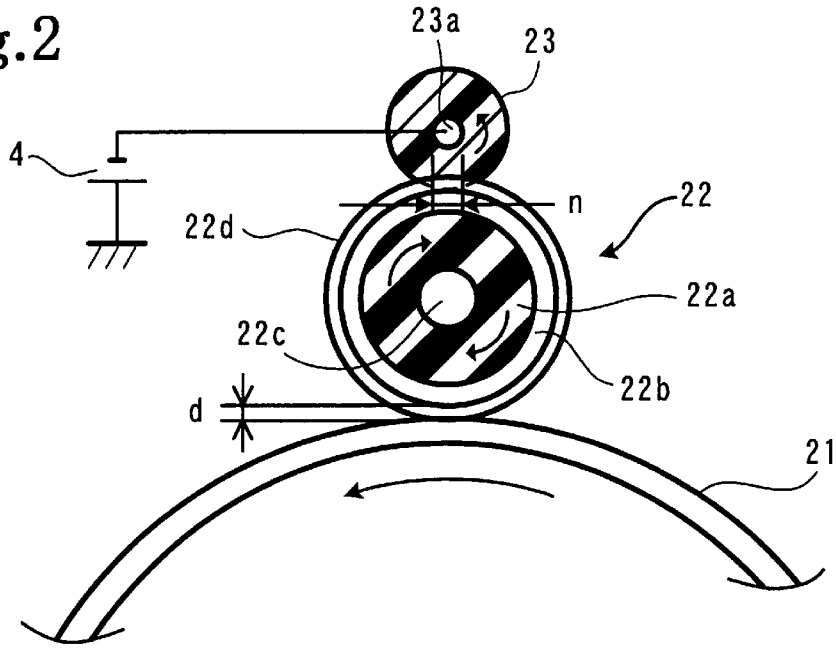
FIG. 2 is a sectional view of the charging device according to the embodiment of the present invention.

As shown in FIG. 2, the charging roller 22 comprises a shaft 22*c*, a base 22*a* provided around the shaft 22*c*, a semiconductive layer 22*b*, such as a layer formed of polyethylene terephthalate (PET), polybutylene terephthalate (PBT), polyester (PE), polypropylene (PP), aramid, polyurethane, silicone, polyamide (nylon), polycarbonate (PVC), polyvinylidene fluoride (PVDF), tetrafluoroethylene-ethylene copolymer (ETFE), or polyimide (PI), provided around the base 22*a*, and collars 22*d* provided at both ends of the charging roller 22. The charging roller 22 rotates with following a rotation of the shaft 22*c* with the whole piece integrated into a single body.

The base 22*a* is formed from an insulation resin such as polycarbonate (PC), polymide (PA), polyimide (PI), polytetrafluoroethylene (PTFE), tetrafluoroethylene-perfluoroalkylvinylether copolymer (PFA), tetrafluoroethylene—ethylene copolymer (ETFE), or the like. The semiconductive layer 22*b* is formed by performing a doping or a coating, or covering a heat shrinkable tube on the base 22*c*. The each collar 22*d* is formed from polyacetal, and has a disk-shape with a hole provided its center. The shaft 22*c* is inserted into the holes A diameter of the collar 22*d* is slightly larger than that of the shaft 22*c*, the base 22*a*, and the semiconductive layer 22*b* united together. Accordingly, only the rims of the collars 22*d* contact with the rim of the photoconductive drum 21 when the charging roller 22 is incorporated into the laser beam printer. Therefore, an extremely narrow space d is formed between the photoconductive drum 21 and the semiconductive layer 22*b*, in the range of 0.1–1.0 mm, and preferably between 0.2–0.5 mm.

The power supply roller 23 is formed from a material having elasticity and conductivity such as conductive urethane, conductive silicone, conductive urethane foam, or the like. A constant-voltage power supply 4 is connected to the shaft 23*a* of the power supply roller 23. When the shaft 23*a* rotates, the power supply roller 23 rotates with shaft 23.

When the shaft 22*c* and the shaft 23*a* are rotated by power from a drive device (not shown), the charging roller 22 and the power supply roller 23 rotate in the opposite direction with respect to each other while contacting each other. At this time, the shaft 22*c* and the shaft 23*a* may be coupled using a gear (not shown). Also, the only shaft 22*c* may be rotated by power and the power supply roller 23 may be structured that it rotates with following a rotation of the charging roller 22. The surfaces of the power supply roller 23 and the charging roller 22 always moves relatively, therefore, the surfaces of the power supply roller 23 and the charging roller 22 are not worn at only certain portions but consistently worn and the current flows statically from the power supply roller 23 to the charging roller 22.

When charging is performed under this condition, the current flows, while spreading in a circumferential direction on the surface of the serniconductive layer 22*b*, from the constant-voltage power supply 4 to the power supply roller 23 via the shaft 23*a*, then from a portion where the power supply roller 23 and the charging roller 22 contact each other to a discharging surface where the charging roller 22 and the photoconductive drum 21 oppose each other. By supplying the power through such a route, a sufficient electrical resistance in the space d between the charging roller 22 and the photoconductive drum 21, approximately $10^9$ ohm, can be obtained, so that the surface of the photoconductive drum 21 can be charged statically and uniformly.

Also, as shown in FIG. 2, a proper nip width n is necessary to be secured in order to supply the current statically from the supply power roller 23 to the charging roller 22 when the power supply roller 23 and the charging roller 22 is contacted each other.

As a result of an experimentation, it is desirable that the nip width is 0.1 mm or more.

Figure 3:
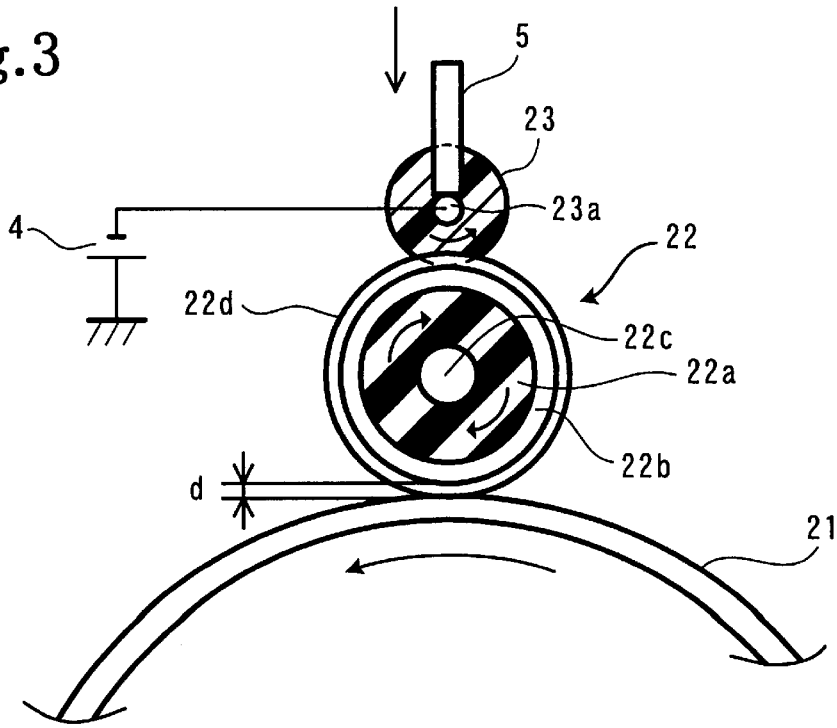
FIG. 3 is a sectional view of the charging device according to the embodiment of the present invention.

FIG. 3 illustrates a charging device undergoing improvements in the charging device shown in FIG. 2. The structure of the charging device shown in FIG. 3 is almost identical in structure with that of the charging device shown in FIG. 2. Therefore, the same components as that shown in FIG. 2 are given the same reference numbers as that of FIG. 2 and an explanation will be omitted.

In the charging device shown in FIG. 3, a press member 5 contacts with both ends of the shaft 23*a* of the power supply roller 23 and presses the power supply roller 23 against the charging roller 22 via the shaft 23*a*. Then the nip width n can be maintained optimally at all times.

If the press member 5 is not provided, as the charging roller 22 and the power supply roller 23 rotates while contacting each other, the portion where the charging roller 22 an the power supply roller 23 contact each other will be worn and the nip width n will be changed. Then, the current will not be supplied statically to the charging roller 22, so that an irregular charging may occur.

In the charging device shown in FIG. 3, the press member 5 is provided in order to solve such a problem. Therefore, even if the peripheral faces of the charging roller 22 and the power supply roller 23 are worn and the diameter of them are changed by contacting each other, the nip width n between the charging roller 22 and the power supply roller 23 can be maintained optimally at all times. The charging roller 22 and the power supply roller 23 contact each other at a plane, so that the current flows from the power supply roller 23 to the charging roller 22 more statically.

Also, a well-known leaf spring, coil spring, or the like can be used for the press member 5.

Figure 4:
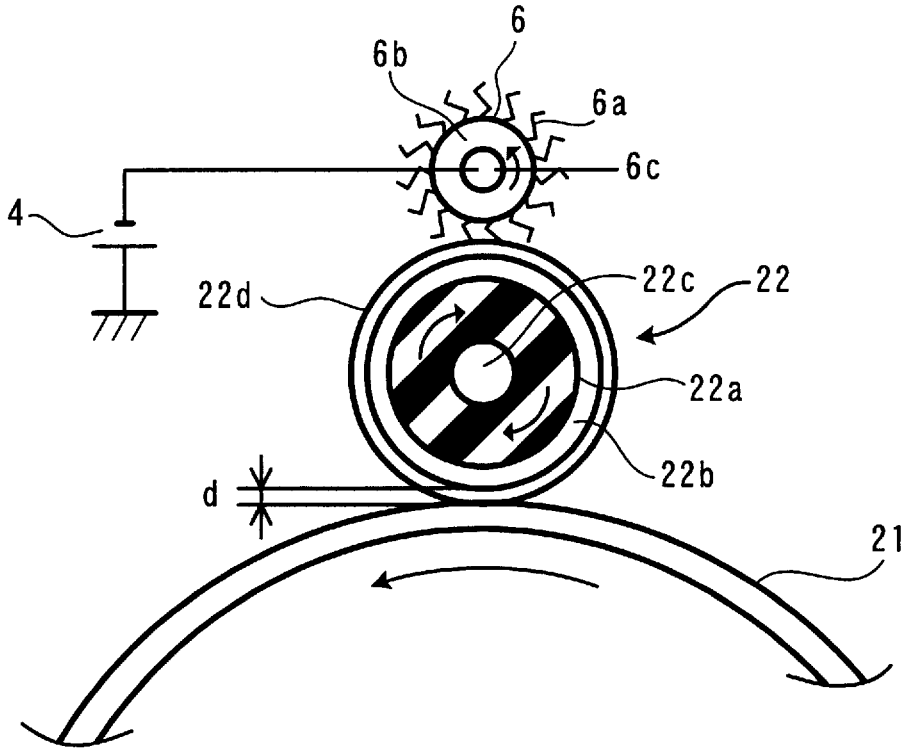
FIG. 4 is a sectional view of the charging device according to the embodiment of the present invention.

FIG. 4 is an example of a charging device undergoing improvements in the charging device of FIG. 2 in another manner. The structure of the charging device shown in FIG. 4 is almost identical in structure with that of the charging device shown in FIG. 2. Therefore, the same components as that shown in FIG. 2 are given the same reference number as that of FIG. 2 and an explanation will be omitted.

In the charging device shown in FIG. 4, a power supply roller 6 contacting with the charging roller 22 comprises a shaft 6*c* and a base 6*b* formed from a conductive material. The base 6*b* is formed around the shaft 6*c*. Further, conductive brushes 6*a* are regularly fixed around the whole surface of the base 6*b* in a longitudinal and a circumferenial direction. By doing so, the portion where the charging roller 22 and the power supply roller 23 contact each other is regarded to be substantially nipping with a certain width therebetween. As described above, it is desirable that the nip width is 0.1 mm or more.

In the power supply roller 6, the current flows from the constant-voltage power supply 4 to the brushes 6 via the shaft 6*c* and the base 6*b*, then flows to the surface of the charging roller 22.

Normally, the surface of the charging roller 22 is exposed to surroundings such that it gets dirty with remaining toner and sheet particles. If the charging roller 22 is dirty, charging can not be performed uniformly, and the image quality will be reduced. That is, the brushes 6*a* are used not only for charging to the charging roller 22 but also for cleaning the surface of the charging roller 22. Therefore, the surface of the charging roller 22 is always kept clean, so that the surface of the charging roller 23 is charged uniformly.

Further, the charging roller 22 and the power supply roller 23 are driven by different motor speeds in order to be rotated with different peripheral speed, so that the charging roller 22 can be effectively cleaned, and then charged uniformly.

Figure 5:
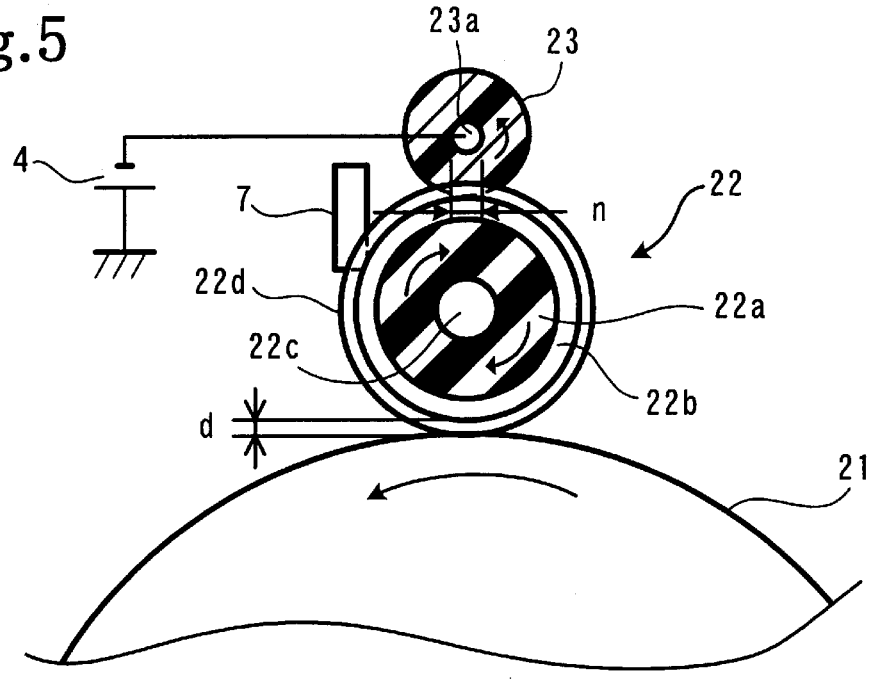
FIG. 5 is a sectional view of the charging device according to the embodiment of the present invention.

Next, another example will be described while referring to FIG. 5. The structure of the charging device shown in FIG. 5 is almost identical in structure with that of the charging device shown in FIG. 2. Therefore, the same components as that shown in FIG. 2 are given the same reference number as that of FIG. 2 and an explanation will be omitted. In the charging device shown in FIG. 5, a cleaning member 7 is provided toward a direction relative to a rotation direction of the charging roller 22 and contacted with the surface of the charging roller 22 to remove the toner and sheet particles from the surface of the charging roller 22.

Since the cleaning member 7 is provided to remove the toner and sheet particles from the surface of the charging roller 22, the surface of the charging roller 22 can be always kept clean and the photoconductive drum 21 can be charged uniformly.

Figure 6:
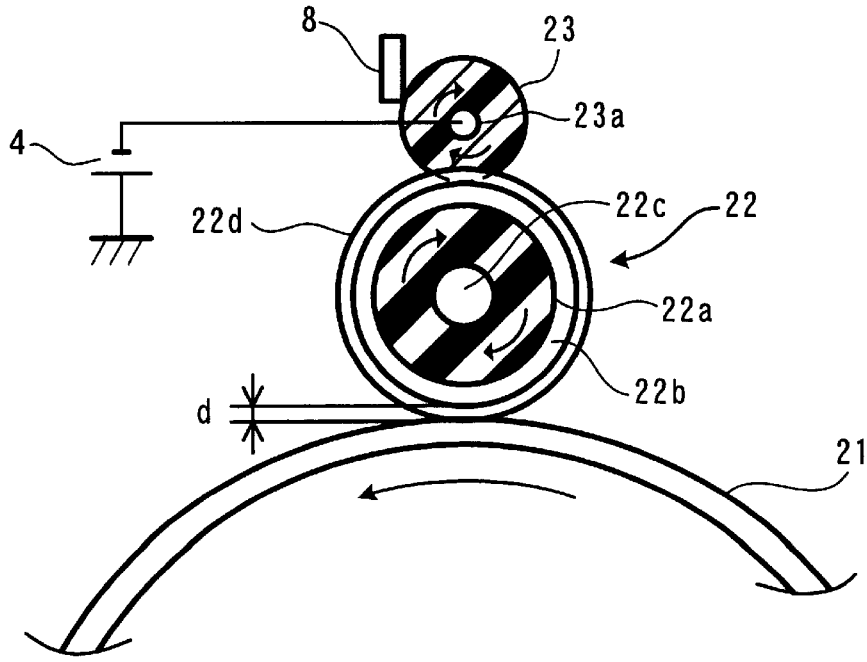
FIG. 6 is a sectional view of the charging device according to the embodiment of the present invention.

Further, FIG. 6 shows other example of a charging device. The structure of the charging device shown in FIG. 6 is almost identical in structure with that of the charging device shown in FIG. 2. Therefore, the same components as that shown in FIG. 2 are given the same reference number as that of FIG. 2 and an explanation will be omitted.

In the charging device shown in FIG. 6, a cleaning member 8 is provided toward a direction relative to a rotation direction of the power supply roller 23 and contacted with the surface of the power supply roller 23.

In the charging device of this type, normally after transferring, the remaining toner and sheet particles on the surface of the photoconductive drum 21 adhere to the surface of the charging roller 22, and further adhere to the power supply roller 23. Under the influence of the remaining toner and sheet particles, a charging efficiency may decline or an irregular charging may occur on the surface of the photoconductive drum 21. As the charging device of FIG. 5, the surface of the charging roller 22 may be cleaned, however, the cleaning member 7 removes the toner and sheet particles by directly contacting with the surface of the charging roller 22, so that the cleaning member 7 is likely to damage the surface of the charging roller 22. The damage may be a factor in a charging defect.

Therefore, as the charging device shown in FIG. 6, the toner and sheet particles transferred from the charging roller 22 to the surface of the power supply roller 23 are removed by contacting the cleaning member 8 with the surface of the power supply roller 23. If the charging device is structured in this manner, the toner and sheet particles can be certainly removed without damaging the surface of the charging roller 22. Therefore, the surface of the photoconductive drum 21 can be charged uniformly. Further, the charging roller 22 is not damaged, so that the durability is increased and a good charging quality can be maintained for a long time.

Figure 7:
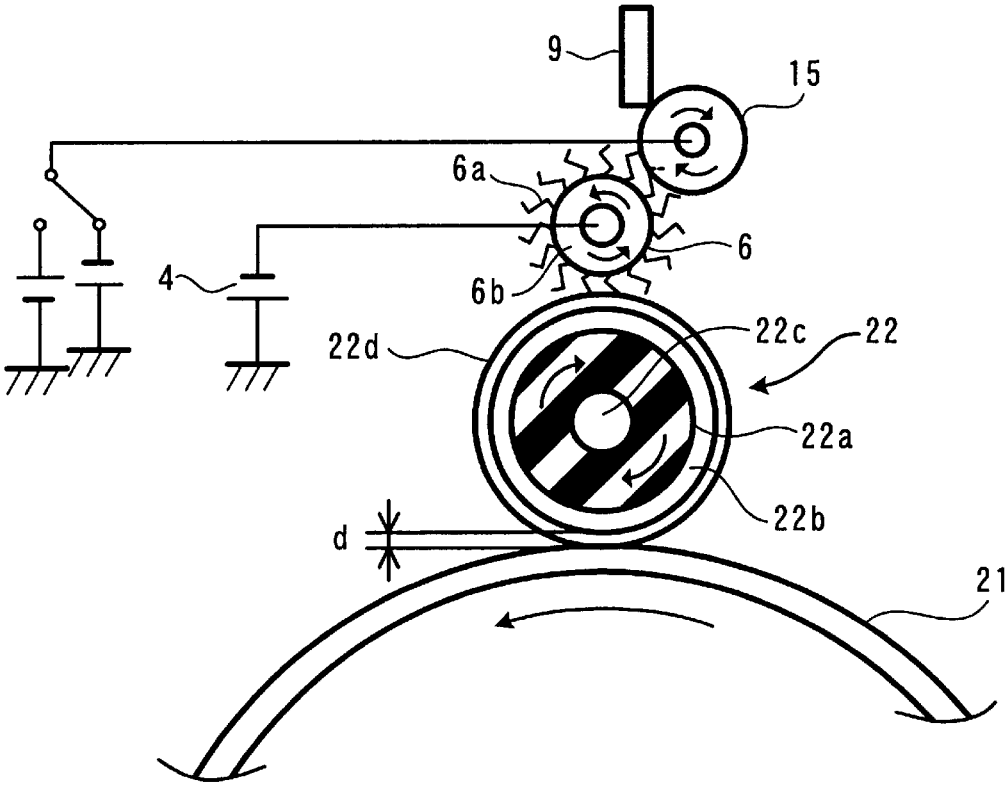
FIG. 7 is a sectional view of the charging device according to the embodiment of the present invention.
Figure 8A:
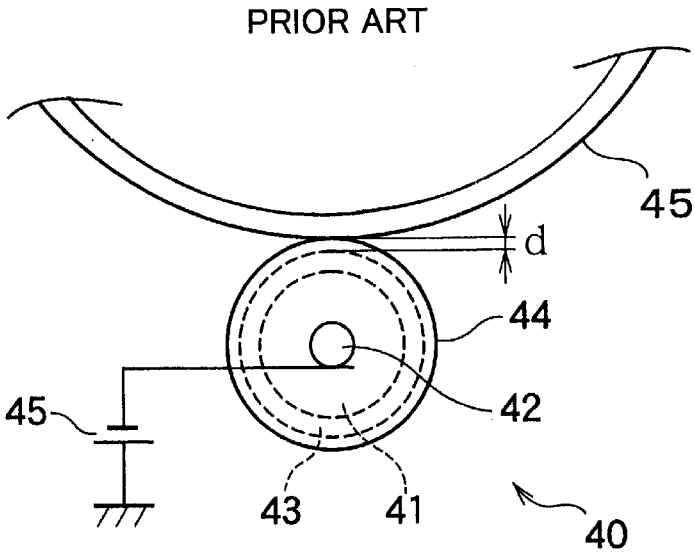
FIGS. 8A and 8B illustrate conventional charging devices.
Figure 8B:
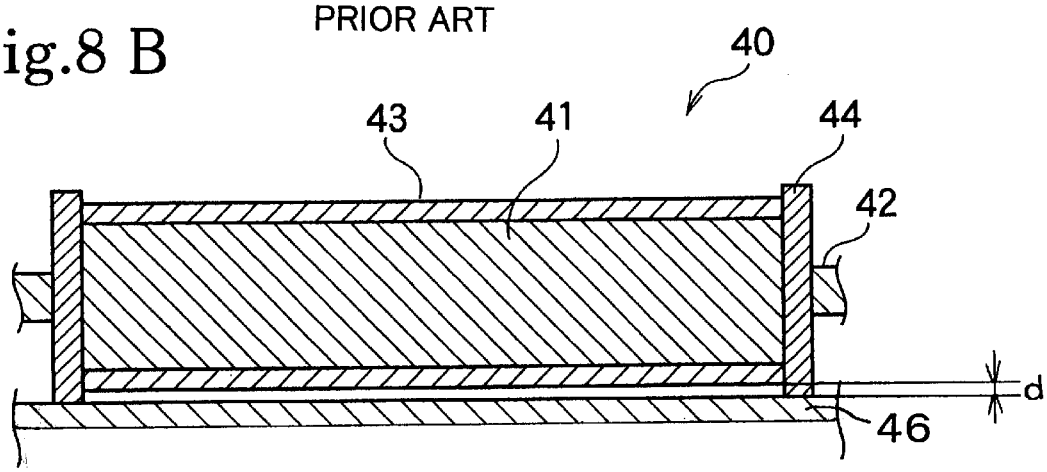

FIG. 7 shows other example of charging device, which partly undergoes improvements in the charging device of FIG. 4. The same components as that shown in FIG. 4 are given the same reference number as that of FIG. 4 and an explanation will be omitted.

In the charging device of FIG. 7, a cleaning roller 15 is rotatably disposed on the surface of the power supply roller 23 having brushes 6 thereof. The cleaning roller 15 is formed from conductive urethane or conductive silicone. A power supply 51 is connected to a shaft 15*a* of the cleaning roller 15 and applies a predetermined bias to the shaft 15*a* of the cleaning roller 15.

On the surface of the cleaning roller 15, a cleaning blade 9 for removing the toner and sheet particles is disposed toward a direction relative to a rotation direction of the cleaning roller 15.

The power supply 51 connected to the shaft 15*a* of the cleaning roller 15 can apply positive and negative potentials to the cleaning roller 15 by changing a switch 52.

In this charging device, the remaining toner and sheet particles on the photoconductive drum 21 adhere to the charging roller 22, however, they are removed from the charging roller 22 by the brushes 6*a* and adhere to the brushes 6*a*. The both positively and negatively charged toner and sheet particles are mixed on the brushes 6*a*. Therefore, to the cleaning roller 15 is applied the positive and negative potentials alternately, then all toner and sheet particles adhering to the brushes 6*a* are transferred to the surface of the cleaning roller 15 due to the potential difference between the power supply roller 6 and the cleaning roller 15.

Then, the toner and sheet particles transferred to the surface of the cleaning roller 15 is cleaned by a cleaning member 9. Therefore, the surface of the charging roller 22 is always kept clean, so that the surface of the photoconductive drum 21 can be charged uniformly.

Also, the charging roller 22 and the power supply roller 6 are driven by different motor speeds in order to being rotated with different peripheral speeds, so that the efficiency in cleaning the surface of the charging roller by the brushes 6*a* can be increased.

What is claimed is:

1. A charging device comprising:

a charging member that charges a surface of a photosensitive member, the charging member including a base made from insulation material and a charging portion made from semiconductive material around the base, the base and the charging portion being united together;

a power supply member that supplies current to the charging member, the power supply member contacting the charging portion of the charging member;

a cleaning member that contacts the charging portion to clean the charging portion; and a pressing member that presses the power supply member toward a surface of the charging member, wherein a nip width of a portion where the power supply member and the charging member contact each other is 0.1 mm or more.

2. The charging device according to claim 1, wherein the charging member is positioned so as to leave a space between the surface of the charging member and the surface of the photosensitive member when the charging member is incorporated into the charging device.

3. The charging device according to claim 1, wherein the power supply member has conductivity and elasticity.

4. The charging device according to claim 1, wherein the charging member is a roller-shaped member comprising:

a shaft portion, wherein the base is provided around the shaft portion and, the charging portion is provided around the base;

wherein the charging device further comprises a spacer disposed so as to leave a space between the charging portion and the photosensitive member.

5. The charging device according to claim 4, wherein the spacer comprises a pair of collars which are provided on the each end of the shaft portion, the collars having a slightly larger diameter of a combined structure of the shaft portion, the base, and the charging portion.

6. The charging device according to claim 5, wherein the power supply member is a roller-shaped member comprising a shaft portion and a power supply portion having conductivity and elasticity.

7. The charging device according to claim 6, wherein a power supply is connected to the shaft portion.

8. The charging device according to claim 7, wherein the charging member and the power supply member rotate in opposite directions with respect to each other.

9. The charging device according to claim 7, further comprising:

a cleaning member that contacts the surface of the charging member to clean the surface.

10. The charging device according to claim 9, wherein the cleaning member is positioned toward a direction relative to a rotation direction of the charging member and removes toner and sheet particles adhering to the surface of the charging member.

11. A charging device comprising:

a charging member that charges a surface of a photosensitive member;

a power supply member that supplies current to the charging member, wherein the power supply member contacts a surface of the charging member; and a cleaning member that contacts the surface of the power supply member to clean the surface.

12. The charging device according to claim 11, wherein the cleaning member is positioned toward a direction relative to a rotation direction of the power supply member and removes toner and sheet particles adhering to the surface of the power supply member.

13. The charging device according to claim 11, wherein the charging member is positioned so as to leave a narrow space between the charging member's surface and a surface of the photosensitive member.

14. The charging device according to claim 11, further comprising:

a pressing member that presses the power supply member toward the surface of the charging member, wherein a nip width of a portion where the power supply member and the charging member contact each other is 0.1 mm or more.

15. The charging device according to claim 11, wherein the charging member is a roller-shaped member comprising:

a shaft portion, wherein a base is provided around the shaft portion and a charging portion is provided around the base; and a pair of collars which are provided on the each end of the shaft portion, the collars having a slightly larger diameter of a combined structure of the shaft portion, the base, and the charging portion.

16. The charging device according to claim 11, wherein the charging member includes a base made from insulation material and a charging portion made from semiconductive material around the base, the base and the charging portion being united together.

17. The charging device according to claim 11, further comprising cleaning member that contacts the charging portion to clean the charging portion.

18. A method of charging a surface of a photosensitive member comprising:

spacing a charging member from the surface of the photosensitive member;

supplying current to the charging member from a power supply member, the power supply member contacting a charging portion of the charging member;

charging the surface of the photosensitive member using the charging member, the charging member including a base made from insulation material and the charging portion made from semiconductive material around the base, the base and the charging portion being united together;

cleaning the charging portion using a cleaning member; and cleaning a power supply surface of the power supply members using a power supply cleaning member that contacts the power supply surface.

19. The method according to claim 18, wherein the power supply cleaning member is positioned toward a direction relative to a rotation direction of the power supply member and removes toner and sheet particles adhering to the surface of the power supply member.

20. A charging device comprising:

a charging member that charges a surface of a photosensitive member, the charging member including a base made from insulation material and a charging portion made from semiconductive material around the base, the base and the charging portion being united together;

a power supply member having brushes provided on a surface, the power supply member supplies current to the charging member, the power supply member contacting the charging portion of the charging member, wherein the brushes have conductivity and elasticity;

a cleaning member that contacts the charging portion to clean the charging portion;

a cleaning roller which contacts with the brushes and is formed from conductive material; and a cleaning member which contacts the surface of the cleaning roller to clean the surface.

21. The charging device according to claim 20, wherein the cleaning member is positioned toward a direction relative to a rotation direction of the cleaning roller and removes toner and sheet particles adhering to the surface of the cleaning roller.

22. The charging device according to claim 20, wherein the cleaning roller is connected to a power supply capable of applying positive and negative potentials.

* * * * *